US005135142A

United States Patent [19]

Tsai

[11] Patent Number: 5,135,142

[45] Date of Patent: Aug. 4, 1992

[54] GARMENT HANGER MADE FROM COMPRESSED SHAPED PLYWOOD PLATE

[76] Inventor: Chun F. Tsai, No. 10, Lane 110, Ming Sheng St., Kuei-Jen Shiang, Tainan Shien, Taiwan

[21] Appl. No.: 685,914

[22] Filed: Apr. 16, 1991

[51] Int. Cl.[5] ..... A47G 25/36; A47G 25/14; B27D 1/00

[52] U.S. Cl. ..... 223/85; 223/92; 144/349; 144/350; 144/2 W; 144/256.3; 264/118; 264/119; 264/320; 264/322

[58] Field of Search ..... 223/85, 88, 92, 95; 264/118, 119, 320, 322; 144/349, 350, 2 W, 2 V, 254, 256.3, 270

[56] References Cited

U.S. PATENT DOCUMENTS

| | | | |
|---|---|---|---|
| 1,154,806 | 9/1915 | Redman | 144/349 |
| 1,580,839 | 4/1926 | McKenna | 223/85 |
| 1,906,979 | 5/1933 | Levin | 223/92 |
| 2,025,451 | 12/1935 | Hirschfield | 144/254 |
| 3,032,243 | 5/1962 | Furno | 223/92 |
| 4,175,106 | 11/1979 | Clarke et al. | 264/119 X |
| 4,495,019 | 1/1985 | Ogg | 144/349 X |
| 5,028,374 | 7/1991 | Imao et al. | 264/119 X |

FOREIGN PATENT DOCUMENTS

| | | | |
|---|---|---|---|
| 0118803 | 9/1980 | Japan | 114/350 |
| 0021560 | of 1914 | United Kingdom | 114/350 |
| 0861411 | 2/1961 | United Kingdom | 114/350 |

*Primary Examiner*—Werner H. Schroeder
*Assistant Examiner*—Bibhu Mohanty
*Attorney, Agent, or Firm*—Fleit, Jacobson, Cohn, Price, Holman & Stern

[57] ABSTRACT

A wooden hanger having a shoulder-shaped frame, a hook and a cross bar fixed between both ends of the frame, which is cut from a shoulder-shaped plywood plate formed into such a shape by compressing it in a mold with heat in a press.

1 Claim, 3 Drawing Sheets

GARMENT HANGER MADE FROM COMPRESSED SHAPED PLYWOOD PLATE

BACKGROUND OF THE INVENTION

A traditional wooden hanger as shown in FIGS. 1, 2 comprises a frame made up of two arms mortised together with help of glue, but it takes substantial time in processing and wastes wooden material to be cut off. Nevertheless, the hanger gives a feeling of naturalness and simplicity, is able to endure a large weight of clothing such as an overcoat or a suit, and so it is still popular.

SUMMARY OF THE INVENTION

The object of this invention is to provide a hanger which can be manufactured more easily and quickly than a traditional one, and much lower in its cost.

The wooden hanger in the present invention has its frame made of a plywood plate, which is compressed with pressure and heat in a mold to form a shoulder shape at first and then cut into a plurality of hanger frames of a proper size. Then each frame is to be ground smooth, bored with a hook hole at its middle for a hook to pass through and then attached with a cross bar between the both ends of the frame to form a finished hanger.

DETAILED DESCRIPTION OF THE INVENTION

Figure 1:
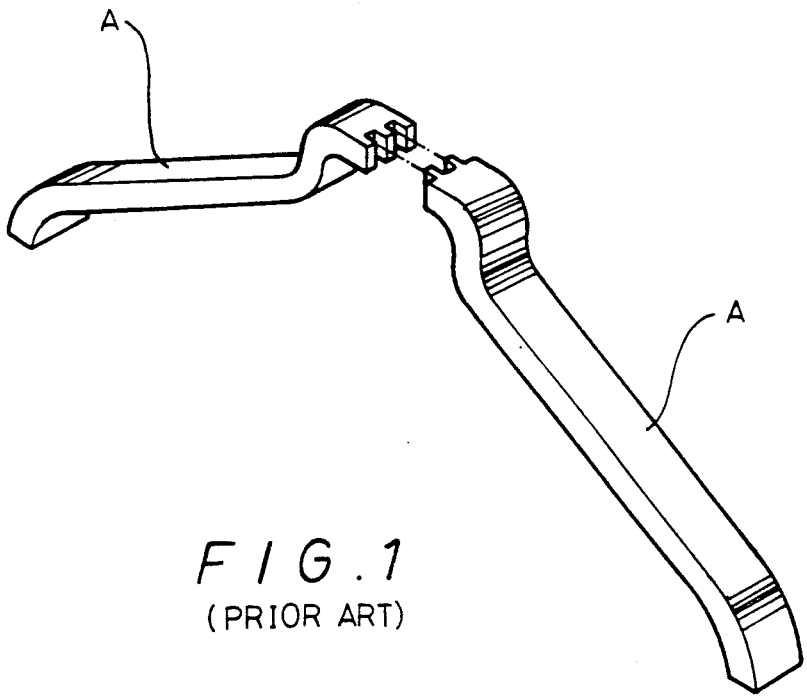
FIG. 1 (PRIOR ART)
FIG. 1 is an explosed perspective view of a traditional wooden hanger.
Figure 2:
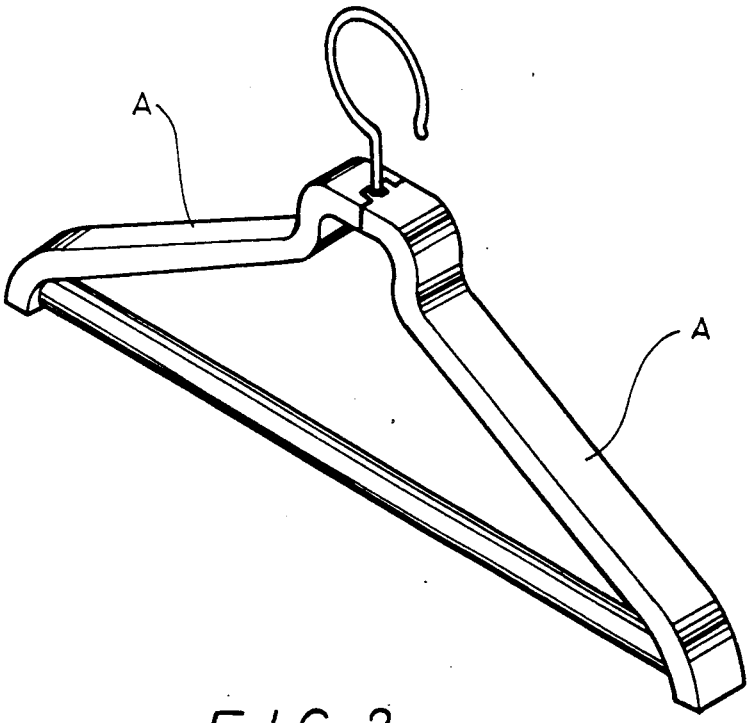
FIG. 2 (PRIOR ART)
FIG. 2 is a perspective view of a traditional wooden hanger.
Figure 3:
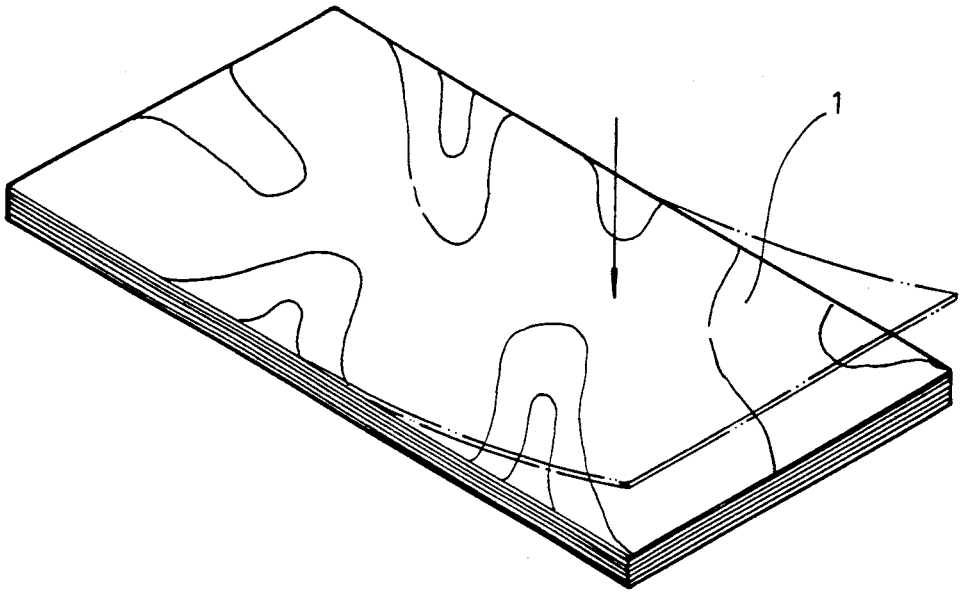
FIG. 3 is a perspective view of a plywood plate to be used in the wooden hanger in the present invention.
Figure 4:
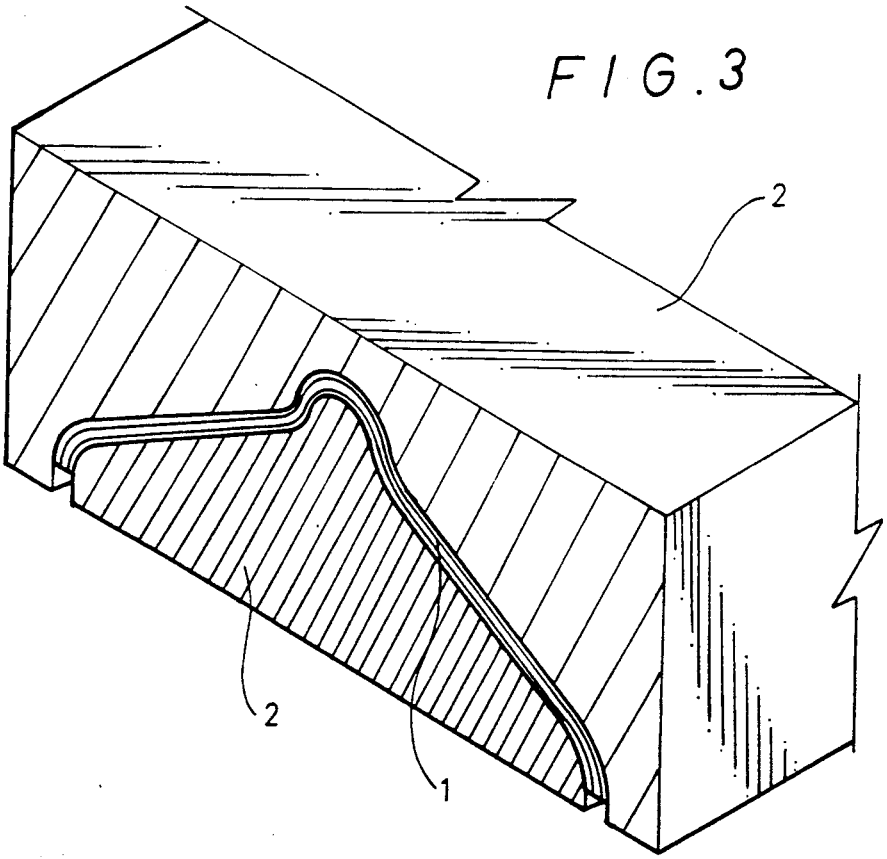
FIG. 4 is a perspective view of the plywood plate compressed in a mold during the manufacturing process of the wooden hanger in the present invention.
Figure 5:
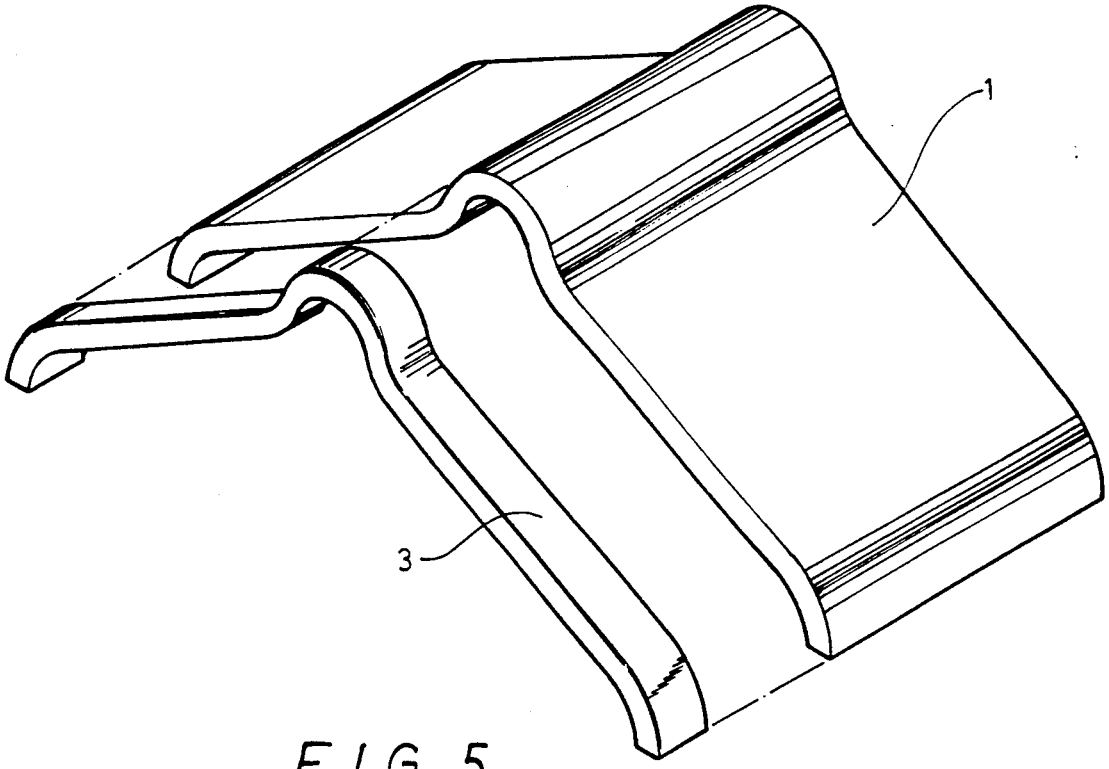
FIG. 5 is a perspective view of the plywood plate compressed to form a shoulder shape of the hanger frame in the present invention.
Figure 6:
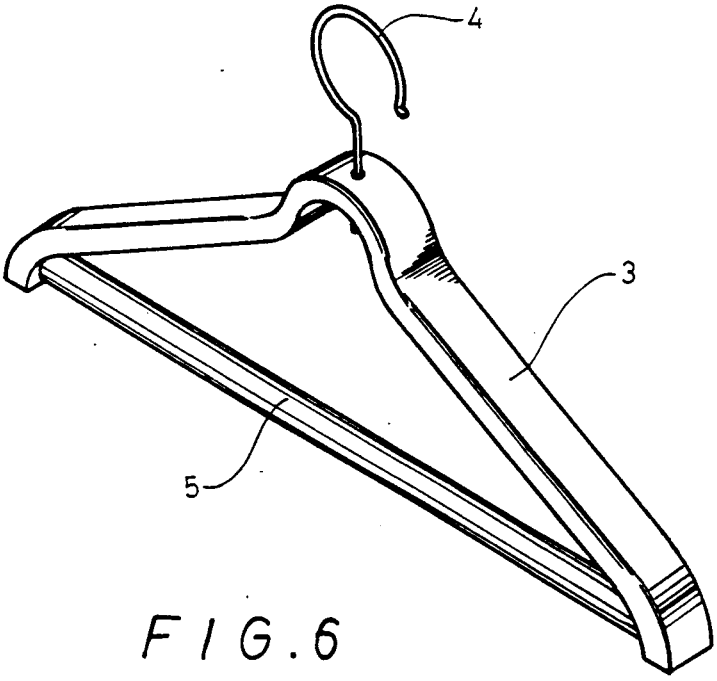
FIG. 6 is a perspective view of a finished wooden hanger in the present invention.

The wooden hanger in the present invention, as shown in FIG. 6 comprises a shoulder-shaped frame 3, a hook 4 extending through the middle of the frame 3, and a cross bar 5 attached between both ends of the frame 3.

The frame 3 having a proper size is made of a plywood plate 1, which is heated, sterilized, dried and compressed in a mold 2 consisting of an upper and a lower section by operation of a high frequency press to become a shoulder-shape and then cut into a plurality of frames 3. Each frame 3 should be also ground smooth after cut, and bored with a through hole at the middle for the hook 4 to pass through.

The processing method of the wooden hanger in the present invention wastes no material at all, speeds productivity, lowers its cost, and keeps the natural grain of wooden material as well.

I claim:

1. A wooden hanger having a shoulder-shaped frame of a proper size, a hook extending through the middle of the frame for hanging the hanger and a cross bar fixed between both ends of the frame, wherein said frame is cut from a shoulder-shaped plywood plate formed into such a shape by compressing the plate in a mold with heat in a press.

* * * * *